US010508494B2

(12) United States Patent
Metz

(10) Patent No.: US 10,508,494 B2
(45) Date of Patent: Dec. 17, 2019

(54) MANIPULATOR FOR A MAST AND SUBSTRUCTURE RAISING CYLINDER

(71) Applicant: Schlumberger Technology Corporation, Sugar Land, TX (US)

(72) Inventor: Robert Metz, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 289 days.

(21) Appl. No.: 15/584,613

(22) Filed: May 2, 2017

(65) Prior Publication Data

US 2018/0320446 A1 Nov. 8, 2018

(51) Int. Cl.

| | |
|---|---|
| ***E21B 7/02*** | (2006.01) |
| ***E21B 19/08*** | (2006.01) |
| ***E21B 15/04*** | (2006.01) |
| ***E21B 3/04*** | (2006.01) |
| ***E21B 15/00*** | (2006.01) |

(52) U.S. Cl.

CPC ..... *E21B 7/02* (2013.01); *E21B 3/045* (2013.01); *E21B 7/023* (2013.01); *E21B 15/003* (2013.01); *E21B 15/04* (2013.01); *E21B 19/08* (2013.01)

(58) Field of Classification Search

CPC . E21B 15/04; E21B 19/08; E21B 7/02; E21B 15/00; B25J 9/14

USPC ..... 173/28, 184

See application file for complete search history.

(56) References Cited

U.S. PATENT DOCUMENTS

| | | | | |
|---|---|---|---|---|
| 2005/0194189 | A1* | 9/2005 | Barnes | E21B 7/02 175/122 |
| 2011/0114386 | A1 | 5/2011 | Souchek | |
| 2012/0167485 | A1* | 7/2012 | Trevithick | E21B 15/00 52/112 |
| 2013/0269268 | A1* | 10/2013 | Thiessen | E21B 15/00 52/118 |
| 2015/0021095 | A1 | 1/2015 | Wijning et al. | |
| 2015/0135607 | A1 | 5/2015 | Ferrari | |
| 2016/0017628 | A1 | 1/2016 | Trevithick et al. | |
| 2016/0312543 | A1 | 10/2016 | Cheng et al. | |

* cited by examiner

*Primary Examiner* — Nathaniel C Chukwurah
(74) *Attorney, Agent, or Firm* — Rachel E. Greene

(57) ABSTRACT

An actuator assembly for a drilling rig includes a cradle actuator coupled to a substructure of a rig, and an actuator bracket having a first end pivotally coupled to the substructure. The actuator bracket is coupled to the cradle actuator. The assembly also includes a cradle having a first end that is pivotally coupled to the actuator bracket and to a first end of a rig-up actuator. The rig-up actuator is receivable at least partially in the cradle. The assembly further includes a front bracket pivotally coupled to the cradle and to the substructure. Extension of the cradle actuator pivots the actuator bracket, the cradle, and the front bracket so as to raise a second end of the rig-up actuator, thereby moving the rig-up actuator from a stowed position to raised position.

16 Claims, 8 Drawing Sheets

MANIPULATOR FOR A MAST AND SUBSTRUCTURE RAISING CYLINDER

BACKGROUND

Oil rigs can be designed to facilitate transporting the rigs from one well location to another. For example, land-based oil rigs may be made of several sub-components that are sized to fit onto trailers and travel on roads from wellsite to wellsite. When received at a wellsite, the sub-components are assembled together as part of a "rig-up" sequence, ending with the rig ready to drill.

Such transportable rig sub-components often include a substructure, a rig floor, and a mast, among others, which may themselves be disassembled into smaller components. For example, the substructure may include a pair of base boxes, connected together by a spreader. The rig floor is supported by the base boxes, and the mast is supported by the rig floor. Rig-up sequences can include attaching the mast to the drill floor, and raising the mast from a horizontal orientation to a vertical orientation. Before or after raising the mast, the rig floor is lifted upwards on the substructure (e.g., by expanding the base boxes), providing room for a cellar around and immediately above the wellhead. Recently, some rig designs, such as those commercially available from SCHLUMBERGER, have provided mast and substructure raising cylinders (MSRCs), e.g., one per base box, which are capable of raising the mast and raising the rig floor in sequence.

Rigs also provide a setback, where the lower ends of stands of drill pipe are supported when in the rack. The setback is often on the rig floor, and thus elevated therewith and clear of the substructure. However, in some applications, the setback may be positioned on the ground, e.g., at the spreader. In these cases, the positioning of the MSRCs may interfere with the setback, which can present a challenge to operation and rig-up.

SUMMARY

Embodiments of the present disclosure may provide an actuator assembly for a drilling rig. The assembly includes a cradle actuator coupled to a substructure of a rig, and an actuator bracket having a first end pivotally coupled to the substructure. The actuator bracket is coupled to the cradle actuator. The assembly also includes a cradle having a first end that is pivotally coupled to the actuator bracket and to a first end of a rig-up actuator. The rig-up actuator is receivable at least partially in the cradle. The assembly further includes a front bracket pivotally coupled to the cradle and to the substructure. Extension of the cradle actuator pivots the actuator bracket, the cradle, and the front bracket so as to raise a second end of the rig-up actuator, thereby moving the rig-up actuator from a stowed position to raised position.

Embodiments of the disclosure may also provide a rig substructure assembly. The assembly includes a first base box configured to at least partially support a drilling floor, and a mast and substructure raising cylinder (MSRC) having a pin end and a clevis. The MSRC is extendable to increase a distance between the pin end and the clevis. The assembly also includes a cradle actuator pivotally coupled to the first base box, an actuator bracket pivotally coupled to the first base box and to the actuator, a cradle pivotally coupled to the actuator bracket and the clevis of the MSRC, and a front bracket pivotally coupled to the cradle and to the base box. The cradle actuator is configured to pivot the actuator bracket, the cradle, and the front bracket so as to raise the pin end of the MSRC and lower the clevis of the MSRC, thereby moving the MSRC from a stowed position to a raised position.

Embodiments of the present disclosure may also provide a method for rig-up of an oilfield rig. The method includes extending a cradle actuator connected to a substructure of the oilfield rig. Extending the cradle actuator causes a cradle connected to the cradle actuator to pivot such that a first end of the cradle is raised with respect to the substructure. A rig-up actuator is positioned at least partially in the cradle, such that movement of the cradle causes the rig-up actuator to move. Extending the cradle actuator raises a pin end of the rig-up actuator with respect to a clevis thereof, thereby moving the rig-up actuator from a stowed position to a raised position. The method also includes extending a manipulator actuator. Extending the manipulator actuator causes the rig-up actuator to pivot about the clevis thereof out of the cradle and to a deployed position. The method further includes connecting the rig-up actuator to a rig floor of the oilfield rig, and extending the rig-up actuator to raise the rig floor.

BRIEF DESCRIPTION OF THE DRAWINGS

The present disclosure may best be understood by referring to the following description and accompanying drawings that are used to illustrate one or more embodiments. In the drawings.

DETAILED DESCRIPTION

Figure 1:
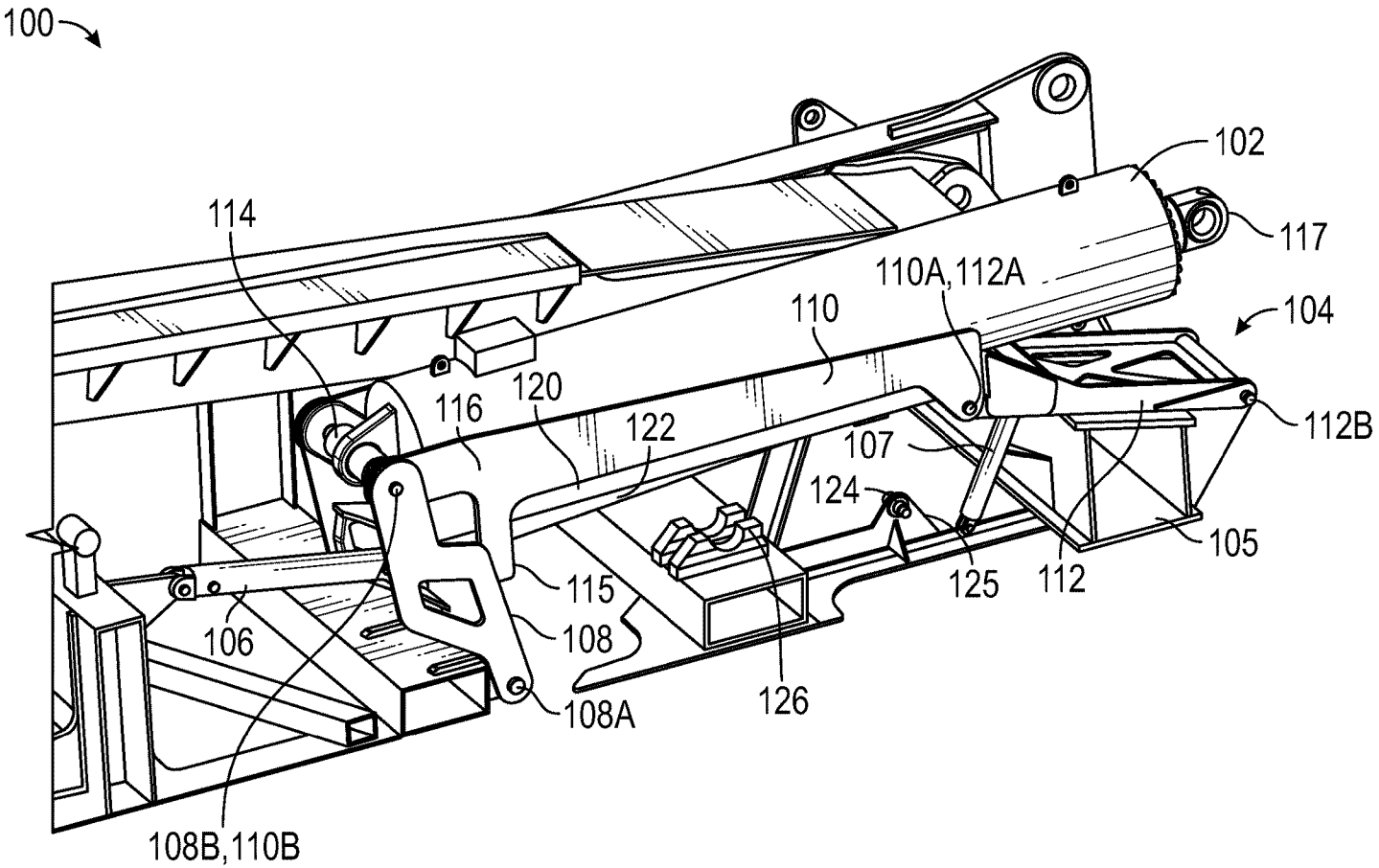
FIG. 1 illustrates a perspective view of an MSRC assembly in a stowed configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, perspective view of a mast and substructure raising cylinder (MSRC) assembly 100 in a stowed configuration, according to an embodiment. The assembly 100 may include a rig-up actuator 102. The rig-up actuator 102 may be hydraulic or another type, and may be configured to raise a rig component as part of a rig-up sequence, e.g., for a transportable rig. In an embodiment, the rig-up actuator 102 may be an MSRC (and will be referred to herein as such), which may be a telescoping, hydraulic cylinder that is extendable, length-wise, from the contracted position illustrated in FIG. 1. For example, during a rig-up sequence, the MSRC 102 may be extended so as to pivot the mast from a horizontal orientation to a vertical orientation, and may also, in some embodiments, be employed to expand a substructure and thereby raise the drill floor away from the ground. Additional details of an embodiment of such a sequence are discussed below.

The MSRC 102 may be movable through a range of positions by operation of the assembly 100, as will be discussed in greater detail below. In some embodiments, the MSRC assembly 100 may operate to move the MSRC 102 from a stowed position (FIG. 1) that may be approximately zero degrees to horizontal, to a deployed position (FIG. 4) that is greater than 90 degrees inclined with respect to horizontal, e.g., such that the MSRC 102 extends in a horizontal direction in the deployed position that is opposite to the horizontal direction in which the MSRC 102 extends in the stowed position. This may provide clearance from a setback in some embodiments.

The assembly 100 may include a cradle subassembly 104 for supporting and moving the MSRC 102. The cradle subassembly 104 may be movably attached to a base box 105 (or another part of the substructure) of a drilling rig. In the illustrated embodiment, the cradle subassembly 104 includes a cradle actuator 106, which may be a hydraulic cylinder or any other suitable type of device (or devices).

The cradle subassembly 104 may also include a cradle actuator bracket 108, a cradle 110, and a front cradle support 112. In some embodiments, the cradle subassembly 104 may also include a front support actuator 107 (e.g., a "boost" or "secondary" cylinder). The front support actuator 107 may be employed to reduce the forces that the cradle actuator 106 is called upon to generate, and thus may allow for a reduction in the size of the cradle actuator 106. However, in some embodiments, the front support actuator 107 may be omitted.

As shown, the cradle actuator bracket 108 may include a first end 108A and a second end 108B. The cradle actuator bracket 108 may be pivotally coupled to the base box 105 at the first end 108A, and pivotally coupled to a clevis 114 of the MSRC 102 at the second end 108B. The cradle actuator 106 may also be pivotally coupled to the cradle actuator bracket 108, between the ends 108A, 108B thereof. The cradle actuator 106 may be configured to extend from its illustrated position so as to force the second end 108B of the cradle actuator bracket 108 to move through an arc towards the base box 105 (i.e., "downward").

The cradle 110 includes an upper end 110A and a lower end 110B. The lower end 110B is pivotally connected to the actuator bracket 108 and, in this embodiment, is pivotally coupled to the clevis 114 of the MSRC 102. The cradle 110 may extend along at least a portion of the MSRC 102 from end 110B to end 110A. For example, as shown, the MSRC cradle 110 extends along at least a majority of the MSRC 102 length (when contracted) from the clevis 114 to an opposing pin end 117 of the MSRC 102. The MSRC cradle 110 may have sidewalls 116, and at least a portion of the MSRC 102 may be received between the sidewalls 116 and into the cradle 110. The cradle 112 may also include a lock bar 115, which may extend generally transverse to the sidewalls 116, toward the base box 105.

The front cradle support 112 may have a first end 112A and a second end 112B. The first end 112A may be pivotally coupled to the MSRC cradle 110, e.g., opposite of the cradle actuator bracket 108. The second end 112B may be pivotally coupled to the base box 105. The front support actuator 107 may be releasable and pivotally coupled to the front support bracket 112 between the first and second ends 112A, 112B. The first end 112A of the front support racket 112 may be moved through an arc away from the base box 105 (i.e., "upward") by extension of the cradle actuator 106 and/or the front support actuator 107, as will be described in greater detail below.

Further, the assembly 100 may include a manipulator bracket 120 and a manipulator actuator 122. The manipulator actuator 122 may be a hydraulic cylinder (or any other suitable device). The manipulator bracket 120 may, in this position, be located between the sidewalls 116, directly under the MSRC 102. The manipulator bracket 120 may be fixed or otherwise coupled to the MSRC 102 so as to be stationary with respect thereto and support the MSRC 102 both in tension and compression (or potentially just compression), as will be better appreciated in subsequent views. The manipulator actuator 122 may be pivotally coupled to the manipulator bracket 120 and the cradle 110. In addition, the base box 105 may include a receiver 126 for receiving and pivotally supporting the clevis 114 of the MSRC 102, as will be described in greater detail below.

Figure 2:
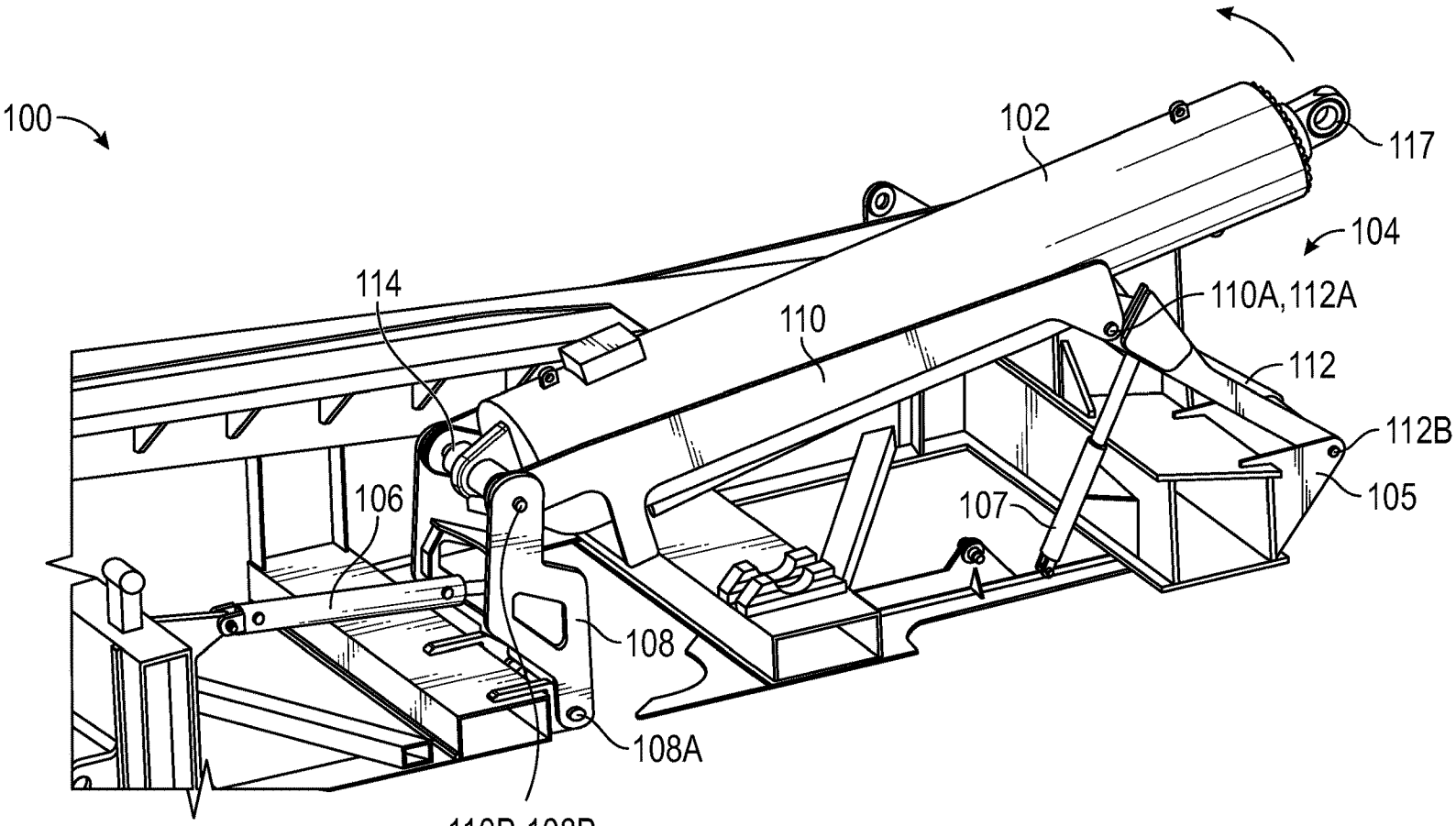
FIG. 2 illustrates a perspective view of the MSRC assembly in an intermediate configuration, according to an embodiment.

FIG. 2 illustrates a perspective view of the MSRC assembly 100 in an intermediate configuration, according to an embodiment. In this configuration, the pin end 117 of the MSRC 102 has been raised, and, consequently, the MSRC 102 is inclined, as compared to the stowed position shown in FIG. 1. To arrive at this configuration from the stowed configuration, the cradle actuator 106 may be extended. This may pivot the second end 108B of the cradle actuator bracket 108 about the first end 108A, generally toward the front cradle support 112. In turn, this pushes the cradle 110 toward the front cradle support 112. Since the front cradle support 112 and the cradle 110 are rigid, this causes the first end 112A of the front cradle support 112 to pivot about the second end 112B, through an arc, away from the cradle actuator bracket 108, thereby raising the upper end 110A of the cradle 110. In embodiments that include the front support actuator 107, the front support actuator 107 may be simultaneously extended, so as to assist in the movement of the front cradle support 112.

Figure 3:
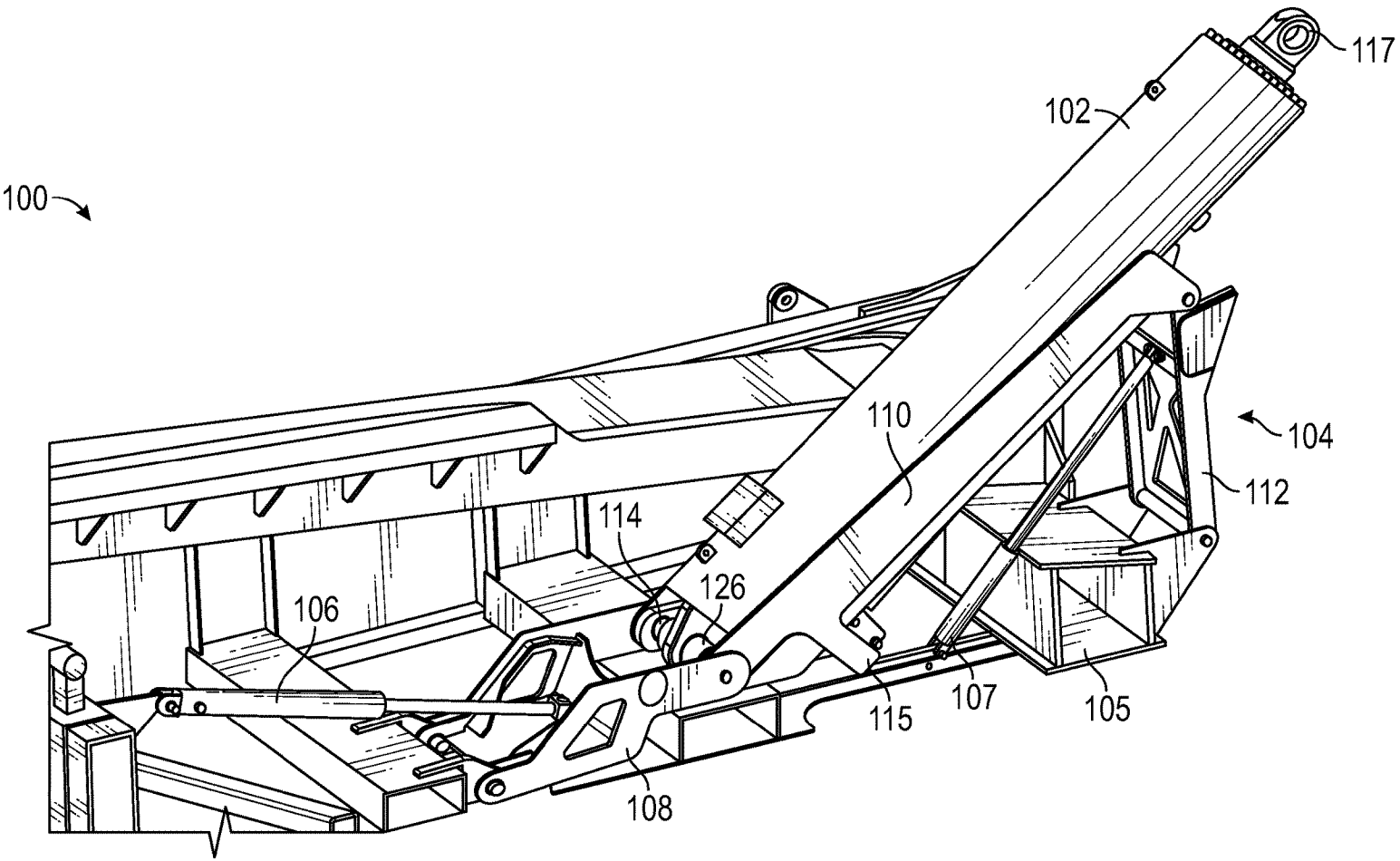
FIG. 3 illustrates a perspective view of the MSRC assembly in a raised configuration, according to an embodiment.

FIG. 3 illustrates a perspective view of the MSRC assembly 100 in a raised configuration, according to an embodiment. In the raised configuration, the MSRC assembly 100 may position the MSRC 102 at a greater incline to the ground in comparison to the intermediate position of FIG. 2. To arrive at this configuration, the cradle actuator 106 may continue extending from the intermediate configuration, eventually causing the cradle actuator bracket 108 to rotate to the base box 105, thereby lowering the elevation of the clevis 114 of the MSRC 102. The front cradle support 112 may continue to rotate away from the cradle actuator bracket 108, continuing to raise the pin end 117 of the MSRC 102 as the clevis 114 is lowered.

As the bracket 108, and the clevis 114 of the MSRC 102 that is connected thereto, approach the base box 105, the clevis 114 may be received into the receiver 126 of the base box 105 and supported therein, so as to transmit forces through the MSRC 102 directly to the base box 105. In this position, the pin end 117 of the MSRC 102 may be farther away from the base box 105, and the clevis 114 may be closer to the base box 105, than in the position of FIG. 2. In some embodiments, the MSRC 102 in the raised position may be inclined at an angle to the horizontal of between about 20 degrees and about 60 degrees.

Further, the lock block 115 may engage the base box 105 in the raised configuration, preventing further movement of the cradle 110. For example, the lock block 115 may engage the protrusion 125 and, in some embodiments, the cradle 110 may be pinned to the protrusion 125 so as to support rotating the MSRC 102 into a tension load on the cradle 110. In other embodiments, the cradle 110 may not be pinned to the MSRC 102. As the cradle actuator 106 is extending, the front support actuator 107 may be disconnected, since its function is generally to assist the initial movement of the cradle 110. However, in some embodiments, the front support actuator 107 may remain attached. In the illustrated embodiment, the front support actuator 107 is disconnected from the front cradle support 112, but in other embodiments, may instead be disconnected from the base box 105, or may be disconnected from both.

Figure 4:
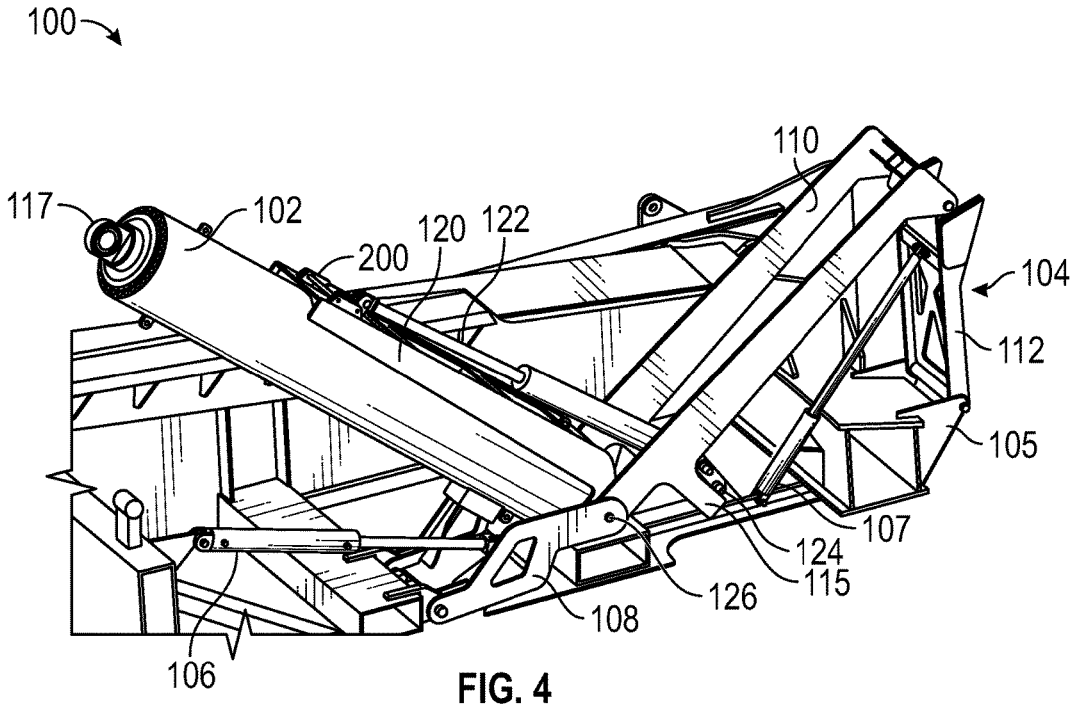
FIG. 4 illustrates a perspective view of the MSRC assembly in a deployed configuration, according to an embodiment.

FIG. 4 illustrates a perspective view of the MSRC assembly 100 in a deployed configuration, according to an embodiment. In this configuration, for example, the pin end 117 of the MSRC 102 may be located in proximity to a "horse head" or another suitable connecting structure, e.g., to commence raising a drilling rig floor.

As shown, the manipulator actuator 122 may be connected at its lower end to the cradle 110, which may be supported by the base box 105, as explained above. The manipulator actuator 122 may be extended, pushing the manipulator bracket 120 away from the cradle 110, such that the MSRC 102 is pivoted about the clevis 114 and out of the cradle 110, such that the pin end 117 moves away from the front bracket 112. The manipulator actuator 122 may thus be employed to push the MSRC 102 into a deployed position via the manipulator bracket 120. As is visible in FIG. 4, a pin 200 may attach the MSRC 102 to the manipulator bracket 120, and the manipulator actuator 122 may be connected to the manipulator bracket 120. Accordingly, it will be appreciated that the assembly 100 lifts the pin end 117 of the MSRC 102 (stowed configuration to raised configuration), and then pivots the MSRC 102 through an arc (raised configuration to deployed configuration) such that the pin end 117 of the MSRC 102 is positioned at an angle of greater than 90 degrees to a horizontal direction in which the MSRC 102 initially extended in the stowed configuration.

Figure 5:
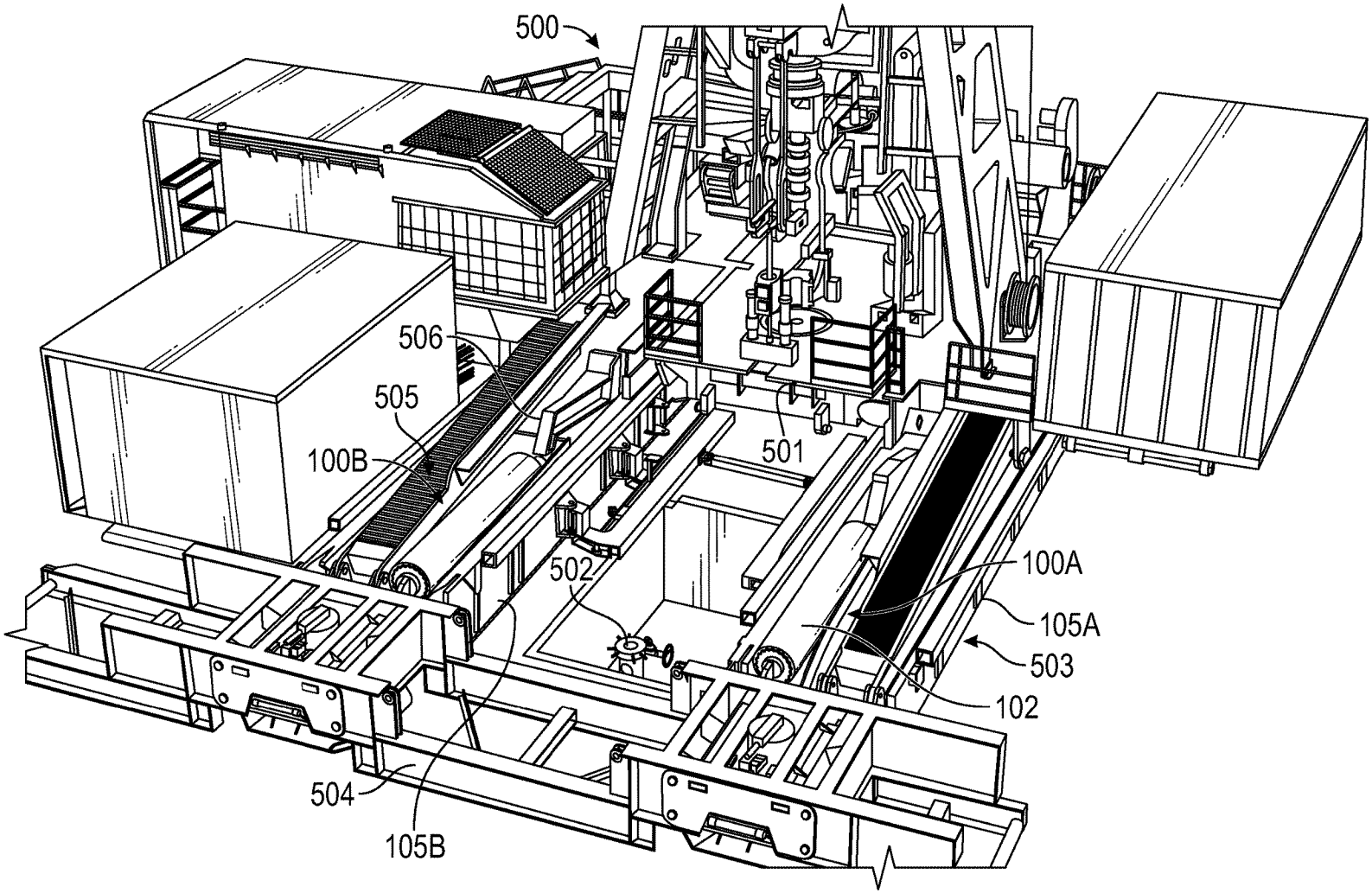
FIG. 5 illustrates a partial view of a rig at a first stage of a rig-up sequence, according to an embodiment.
Figure 6:
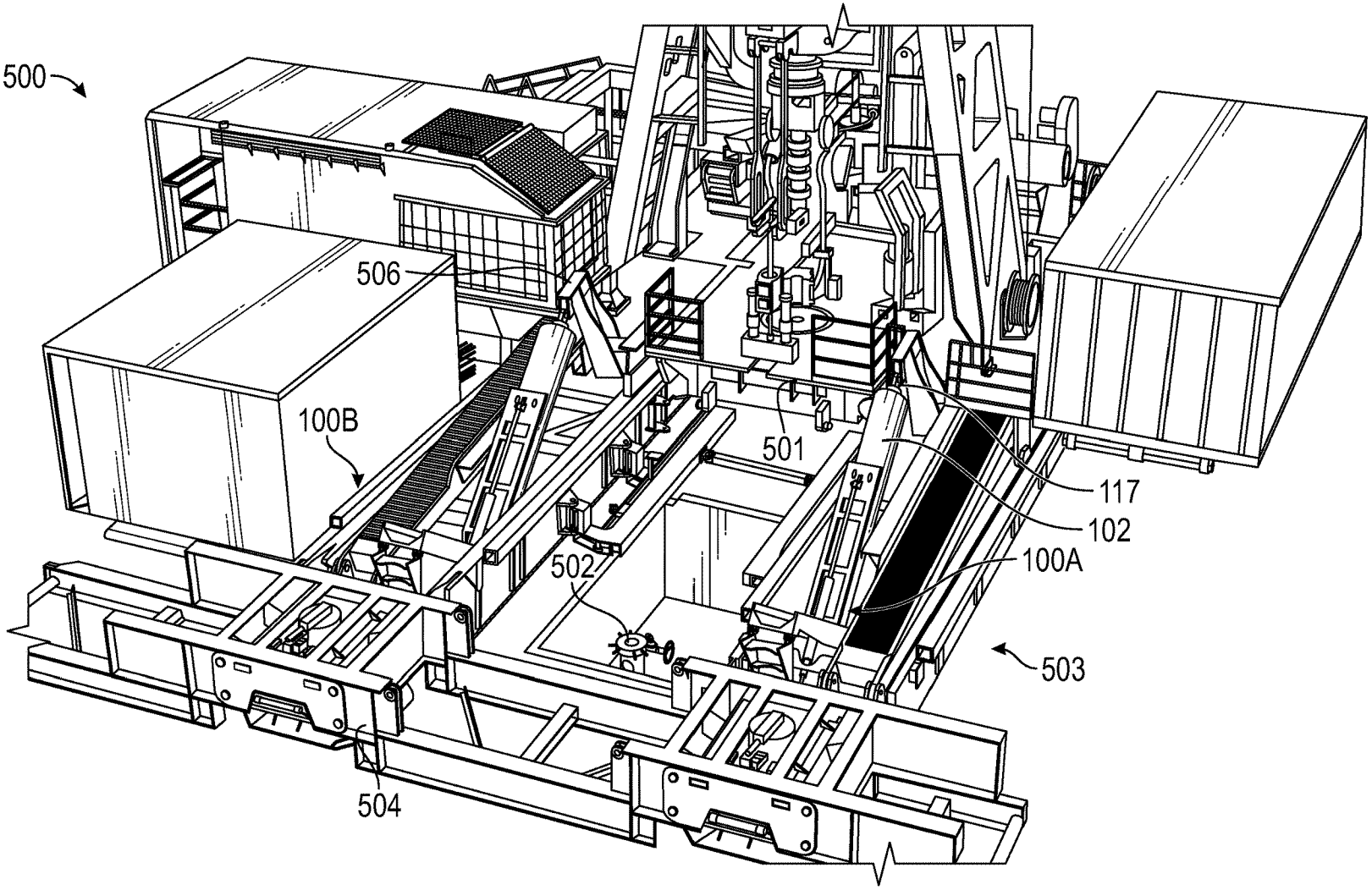
FIG. 6 illustrates a partial view of a rig at a second stage of a rig-up sequence, according to an embodiment.
Figure 7:
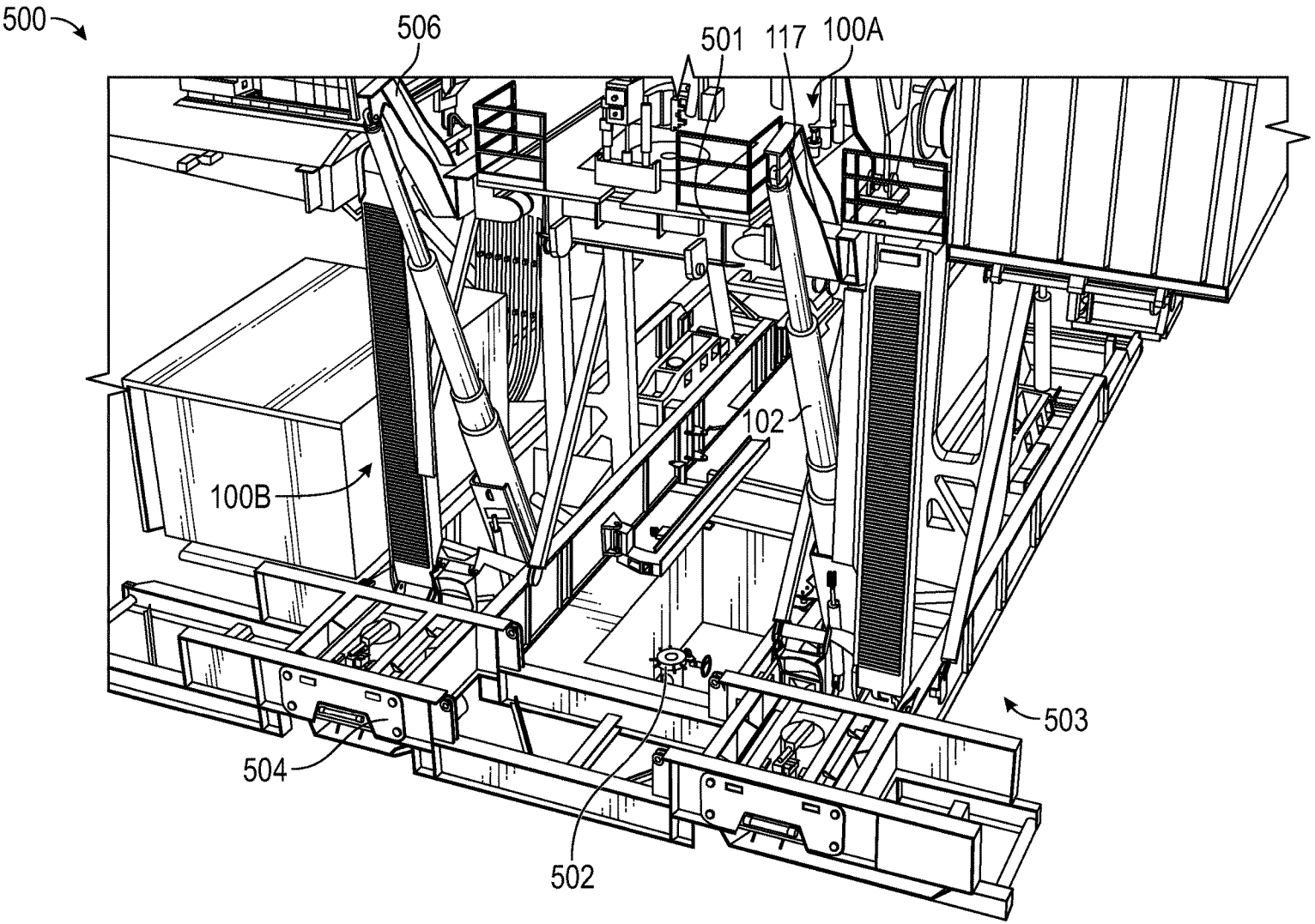
FIG. 7 illustrates a partial view of a rig at a third stage of a rig-up sequence, according to an embodiment.

Having described the components of the MSRC assembly 100, operation of the MSRC assembly 100 in the context of a rig-up sequence may assist in a more complete understanding of the present disclosure. Accordingly, FIGS. 5, 6, and 7 illustrate a portion of a rig 500 at three different stages of an example of a rig-up sequence for raising a drill floor 501 of the rig 500, according to an embodiment. In particular, the illustrated rig 500 includes two base boxes 105A, 105B, each with an MSRC assembly 100A, 100B, which may be representative of one or more of the embodiments of the MSRC assembly 100 discussed above. The operation of the MSRC assembly 100A will be described below, with it being appreciated that the MSRC assembly 100B may operate in substantially the same manner.

The base boxes 105A, 105B may be positioned generally parallel and on opposite sides of a wellhead 502 as part of a rig substructure 503. Extending between the base boxes 105A, 105B is a spreader 504, which also forms part of the substructure 503. In some embodiments, the spreader 504 may provide the setback, i.e., where the lower ends of stands of drill pipes racked in the racking board are supported, rather than on the drill floor. In other embodiments, the setback may be found in its more typical location on the drill floor, above the ground when the rig-up sequence is complete. However, the MSRC assembly 100A may be configured to avoid obstructing the setback in situations where the setback is provided on the ground, as shown.

The MSRC assembly 100A is in the stowed configuration in FIG. 5. The MSRC 102 is laid generally flat (horizontal), and contained at least partially within a pocket 505 formed in the base box 105A. A pivotable connecting structure (a "horse head") 506 is connected to the rig floor 501 and may be received over a part of the cradle subassembly 104, as shown, e.g., covering at least the cradle actuator 106 (see FIG. 1) and thereby providing for a compact design that facilitates assembly of the rig floor 501. As can be seen, the MSRC 102 does not overlap or otherwise interfere with the setback spreader 504.

Proceeding to FIG. 6, when the rig floor 501 is ready to be raised, the MSRC assembly 100 may move through the raised configuration to the deployed configuration, raising and pivoting the MSRC 102 as discussed above. In the deployed position, the MSRC 102 may be connected at its pin end 117 to the horse head 506. As explained above, the MSRC 102 is locked into the base box 105A in this configuration, and thus is able to transmit loads thereto along the incline of the MSRC 102. As shown in FIG. 7, the MSRC 102 may then be extended. Extending the MSRC 102 may raise the drill floor 501 through an arc, due to its pivotal connection with the horse head 604, and into a raised position. The rig substructure 503 may then be locked in position, thereby securing the rig floor 501 in its raised configuration, as shown. The MSRC 102 may be disconnected, retracted, and returned to the stowed position. Lowering the rig floor 501 may proceed by deploying the MSRC 102, attaching it to the horse head 506, releasing the connections between the rig floor 501 and the substructure 503 that maintain the position of the rig floor 501, retracting the MSRC 102, disconnecting the MSRC 102, and again stowing the MSRC 102.

Figure 8:
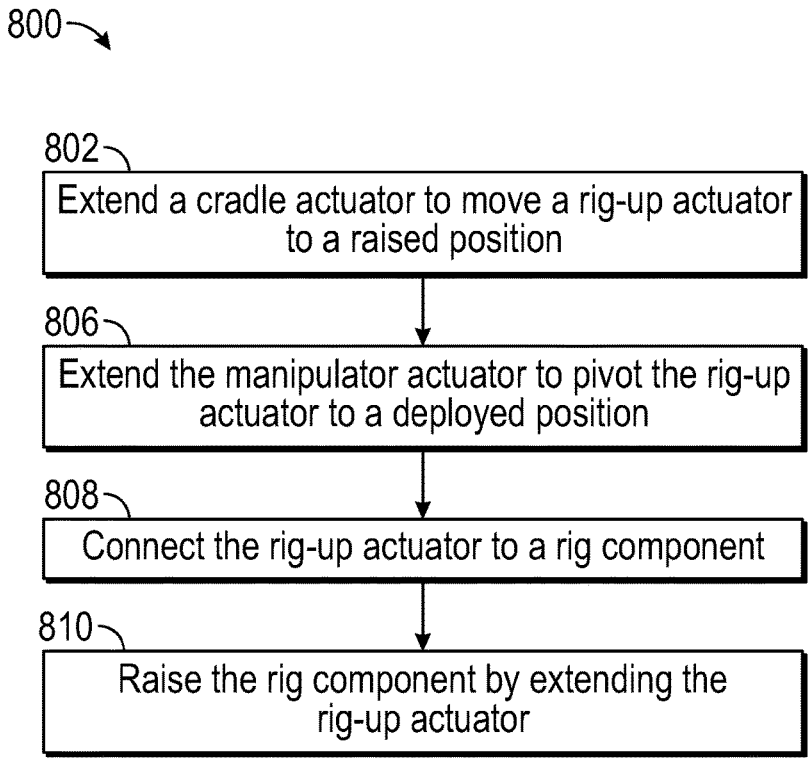
FIG. 8 illustrates a flowchart of a method for raising a drilling rig floor, according to an embodiment.

The disclosure may also include one or more embodiments of a method for raising a rig structure. FIG. 8 illustrates a flowchart of such a method 800, according to an embodiment. The method 800 may be understood with reference to the MSRC assembly 100 and the rig 500 discussed above, but at least some embodiments may employ other structures, and thus the method 800 should not be considered specific to any particular structure, unless otherwise specified herein.

The method 800 may begin by extending a cradle actuator 106 to move a rig-up actuator 102 (e.g., the MSRC) to a raised position, as at 802. Extending the actuator 106 causes a cradle 110 connected to the actuator 106 to pivot such that an upper end 110A of the cradle 110 is raised with respect to the substructure 105. The rig-up actuator 102 may be positioned at least partially in the cradle 110, and thus may also move so as to be inclined by movement of the upper end 110A of the cradle 110. In an embodiment, the method 800 may also include extending a secondary actuator 107 connected to a front bracket 112 that is connected to the cradle 110, e.g., simultaneously to extending the actuator 106. Extending the secondary actuator 107 may force an end 110A of the cradle 110 upward.

In an embodiment, the actuator 106 is connected to an actuator bracket 108 that is pivotally connected to the cradle 110, such that extending the actuator 106 causes an upper end 108B of the actuator bracket 108 to pivot downward. Further, in an embodiment, extending the actuator 106 causes a lock block 115 of the cradle 110 to engage a protrusion 125 of the substructure 105. Further, extending the actuator 106 causes a clevis 114 of the rig-up actuator 102 to be received into a receiver 126 of the substructure 105.

The method 800 may further include extending a manipulator actuator 122 pivotally connected to the rig-up actuator 102 and the cradle 110, so as to pivot the rig-up actuator 102 away from the cradle 110 to a deployed position, as at 806. The method 800 may further include connecting the rig-up actuator to a rig component (e.g., a horse head, mast, etc.), as at 808. The method 800 may also include raising the rig component by extending the rig-up actuator 102.

By execution of the method 800, the rig-up actuator 102 may thus be moved from a stowed position, where the rig-up actuator 102 extends at generally zero degrees with respect to the horizontal, to a deployed position wherein the rig-up actuator 102 is inclined by greater than about 90 degrees. Such incline may be achieved by a combination of extending the cradle actuator 106 (e.g., to raise the pin end 117) and extending the manipulator actuator 122 (pivoting the pin end 117).

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial configuration. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An actuator assembly for a drilling rig, comprising:

a cradle actuator coupled to a substructure of a rig;

an actuator bracket having a first end pivotally coupled to the substructure, the actuator bracket being coupled to the cradle actuator;

a cradle having a first end that is pivotally coupled to the actuator bracket and to a first end of a rig-up actuator, wherein the rig-up actuator is receivable at least partially in the cradle; and a front bracket pivotally coupled to the cradle and to the substructure, wherein extending the cradle actuator pivots the actuator bracket, the cradle, and the front bracket so as to raise a second end of the rig-up actuator.

2. The assembly of claim 1, wherein extending the cradle actuator causes a second end of the actuator bracket to pivot about the first end of the actuator bracket, and wherein the second end moves in an arc downward, toward a ground.

3. The assembly of claim 2, wherein extending the cradle actuator causes a first end of the front bracket to pivot about a second end of the front bracket, and wherein the first end moves in an arc upward, the first end being connected to a second end of the cradle.

4. The assembly of claim 3, further comprising a secondary actuator coupled to the substructure and to the front bracket, wherein the secondary actuator is extendable to assist in moving the first end of the front bracket in the arc upward.

5. The assembly of claim 1, wherein the rig-up actuator comprises a mast and substructure raising cylinder (MSRC) configured to connect to a mast, to raise or lower the mast, and configured to connect to a rig floor, to raise or lower the rig floor.

6. The assembly of claim 1, wherein the cradle comprises a sidewall and a lock bar that extends transversely to the sidewall, and wherein the lock bar is configured to bear against a protrusion of the substructure when the rig-up actuator is in a raised position.

7. The assembly of claim 1, further comprising:

a manipulator bracket pivotally connected to the cradle and coupled to the rig-up actuator; and a manipulator actuator pivotally connected to the manipulator bracket, wherein the manipulator actuator is configured to pivot the rig-up actuator with respect to the cradle.

8. The assembly of claim 7, wherein:

the cradle actuator is configured to raise the second end of the rig-up actuator and lower the first end of the rig-up actuator, so as to move the rig up actuator from a stowed position to a raised position; and the manipulator actuator is configured to pivot the second end of the rig-up actuator away from the front bracket, to move the rig-up actuator from a raised position to a deployed position.

9. The assembly of claim 8, wherein, in the stowed position, the rig-up actuator extends at an angle of about zero degrees to horizontal, and in the deployed position, the rig-up actuator extends at an angle of greater than 90 degrees to the horizontal.

10. A rig substructure assembly, comprising:

a first base box configured to at least partially support a drilling floor;

a mast and substructure raising cylinder (MSRC) having a pin end and a clevis, wherein the MSRC is extendable to increase a distance between the pin end and the clevis;

a cradle actuator pivotally coupled to the first base box;

an actuator bracket pivotally coupled to the first base box and to the actuator;

a cradle pivotally coupled to the actuator bracket and the clevis of the MSRC; and a front bracket pivotally coupled to the cradle and to the base box, wherein the cradle actuator is configured to pivot the actuator bracket, the cradle, and the front bracket so as to raise the pin end of the MSRC and lower the clevis of the MSRC, to move the MSRC from a stowed position to a raised position.

11. The assembly of claim 10, wherein the first base box comprises a receiver configured to receive the clevis of the MSRC when the MSRC is in the raised position.

12. The assembly of claim 10, wherein:

the cradle comprises a lock block;

the first base box comprises a protrusion; and the lock block bears on the protrusion when the MSRC is in the raised position.

13. The assembly of claim 12, further comprising a secondary actuator connected to the front bracket and configured to pivot an upper end of the front bracket upward, wherein the secondary actuator is connected to the protrusion of the base box.

14. The assembly of claim 10, further comprising a second base box positioned generally parallel to the first base box, and a spreader extending transversely and connecting together the first and second base boxes, the spreader being configured to provide a setback for stands of drill pipe, wherein the pin end of the MSRC in the stowed position does not overlap the spreader.

15. The assembly of claim 10, further comprising:

a manipulator bracket pivotally connected to the cradle; and a manipulator actuator pivotally connected to the manipulator bracket and the cradle, wherein the manipulator actuator is extendable to move the pin end of the MSRC away from the front bracket through an arc to a deployed position.

16. The assembly of claim 15, wherein the MSRC in the deployed position is connectable at its upper end to a mast, to raise the mast, and wherein the MSRC in the deployed position is connectable at its upper end to the drilling floor, to raise the drilling floor.

* * * * *